US005351266A

United States Patent [19]

Bullon Camarasa et al.

[11] Patent Number: 5,351,266

[45] Date of Patent: Sep. 27, 1994

[54] PROCESS FOR CONTINUOUS MANUFACTURE OF IMPURITY AND IRON-FREE ELECTRODES FOR ELECTRIC ARC FURNACES

[75] Inventors: Francisco J. Bullon Camarasa; Juan J. Ropero Beltran; Juan A. Benedit del Burgo, all of La Coruna, Spain

[73] Assignee: Ferroatlantica, S.L., Madrid, Spain

[21] Appl. No.: 968,517

[22] Filed: Oct. 29, 1992

[30] Foreign Application Priority Data

Oct. 30, 1991 [ES] Spain ..... 91 02414

[51] Int. Cl.[5] ..... H05B 7/09

[52] U.S. Cl. ..... 373/89; 373/97

[58] Field of Search ..... 373/89, 88, 90–92, 373/94, 97–101

[56] References Cited

U.S. PATENT DOCUMENTS

| | | | |
|---|---|---|---|
| 1,441,037 | 1/1923 | Soderberg | 373/88 |
| 1,498,582 | 6/1924 | Soderberg | 373/89 |
| 1,579,824 | 4/1926 | Laurell | 373/89 |
| 1,613,212 | 1/1927 | Westly | 373/89 |
| 1,691,505 | 11/1928 | Walther | 373/89 |
| 3,524,004 | 8/1970 | Nostran et al. | 373/89 |
| 3,819,841 | 6/1974 | Persson | 373/89 |
| 4,575,856 | 3/1986 | Persson | 373/89 |

*Primary Examiner*—Bruce A. Reynolds
*Assistant Examiner*—Tu Hoang
*Attorney, Agent, or Firm*—Dennison, Meserole, Pollack & Scheiner

[57] ABSTRACT

An improved process for the continuous manufacture of impurity and iron-free electrodes for electric arc furnaces including a mechanism allowing the replacement of an amorphous coal electrode by a graphite core electrode without extensive furnace shutdown. A dual sliding system is provided which allows an electrode to be continuously baked and provided to the furnace with or without a metal casing and which includes a special contact plate for transmitting electric current which decreases substantially the contact surface of the plate. The process is especially useful for obtaining impurity free elemental silicon.

5 Claims, 4 Drawing Sheets

PROCESS FOR CONTINUOUS MANUFACTURE OF IMPURITY AND IRON-FREE ELECTRODES FOR ELECTRIC ARC FURNACES

BACKGROUND OF THE INVENTION

The invention relates to the process for the continuous manufacture of electrodes which are used in electric arc furnaces.

Elemental silicon is obtained in a submerged electric arc furnace by reducing quartz with several classes of coals, according to the simplified reaction $SiO_2+2C \rightarrow Si+2CO$. An arc jumps between the electrode and the furnace sole, which generates the necessary energy to carry out this solid-solid reaction process.

When the electric arc jumps between the electrode and the sole, a gradual and continuous consumption of the electrode is produced, which forms a part of the reaction of the metal production. The electrode gradually moves downward within the furnace, and must be replaced from above by a continuous process in which a SODERBERG paste is introduced into a metal casing to produce a self-baking electrode. In this process, the paste melts, solidifies, slips and burns out.

As the electrode is consumed, the metal casing melts and introduces impurities, particularly iron, into the furnace, making it impossible to manufacture high purity elemental silicon.

An attempt to avoid this problem is disclosed in U.S. Pat. No. 4,575,856, corresponding to Spanish Patent 543259, in which a central core or nucleus made of graphite is used, and replacement of the consumed electrode is made by extrusion through the metal casing so that the casing does not burn out and contaminate. The electrode body is formed from several cylindrical sections which are united at the ends, and the metal casing has flat and uniform sides in its cross-section.

SUMMARY OF THE INVENTION

It is an object of the invention to enable the replacement of electrodes continuously, without introduction of iron or other impurities into the furnace.

It is also an object of the invention to change the electrode from the conventional type made of amorphous coal to a new type made from graphite and paste, without the need for causing a long furnace shutdown to change the electrode column, but gradually achieving the new electrode as the electrode column exhausts.

Another object of the invention is to utilize a dual sliding system to allow the replacement electrode to slide with or without the metal casing, since introduction of the casing may be necessary on limited occasions.

Another object of the invention is to provide a contact plate for transmitting electrical current, decreasing substantially the contact area and concentrating, within a minimal and given area, the electric current to favor the electrode baking.

Another object of the invention is to make it possible to provide an adequate height of the contact plates over the mixture in order not to damage the casing and to adequately bake the paste.

Another object of the invention is to carry out a continuous sliding of the electrode to improve the paste baking.

BRIEF DESCRIPTION OF THE DRAWINGS

The invention may be better understood by reference to the attached drawings in which.

DESCRIPTION OF THE PREFERRED EMBODIMENTS

Figure 1:
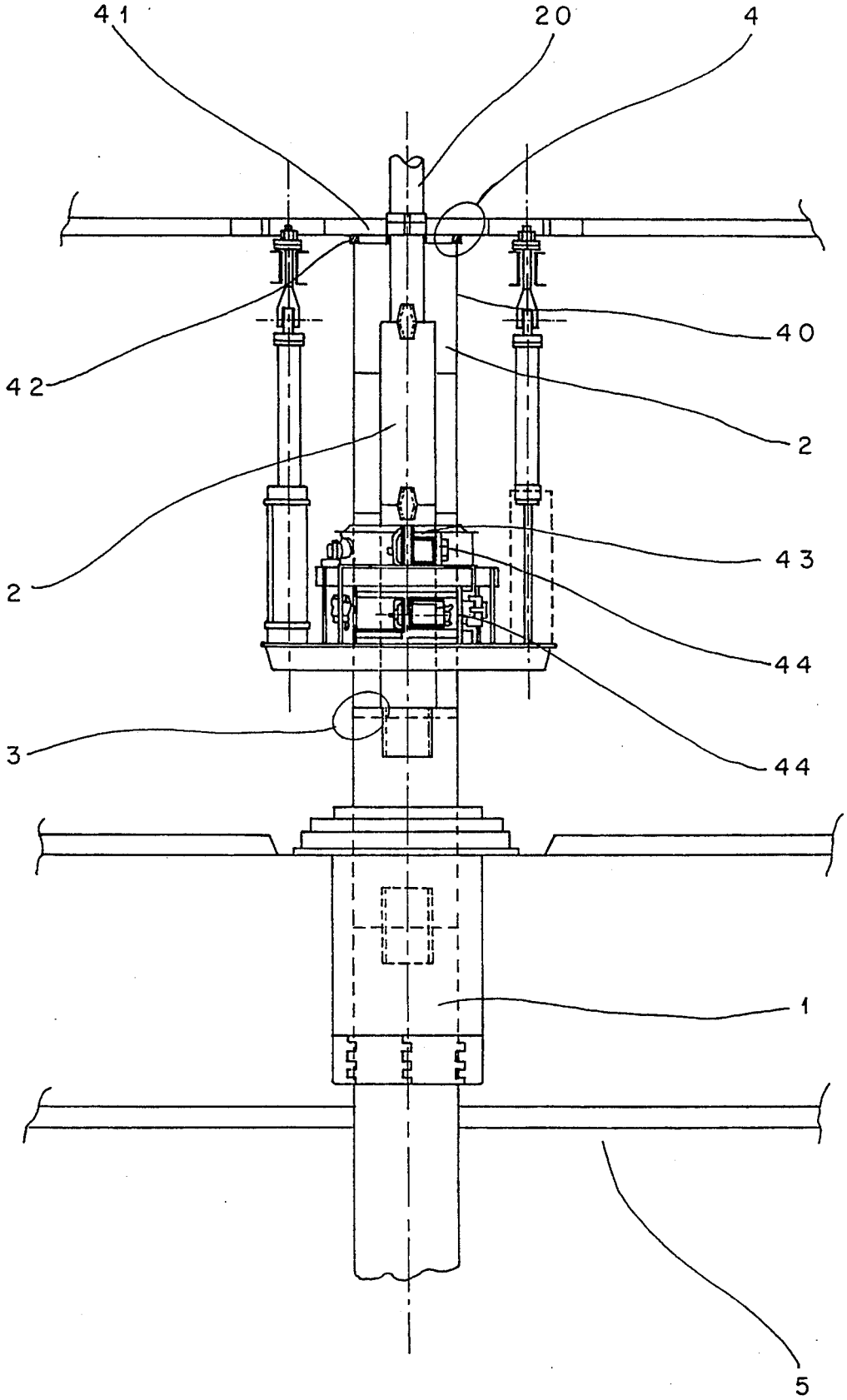
FIG. 1 is an elevational view of an apparatus for replacing an amorphous coal electrode with a graphite and paste electrode.

FIG. 1 shows an electrode column in which a running transition is made from a convention amorphous coal electrode 1 through a series of consecutive graphite electrodes 2 with an evident reduction in their diameter or section, until arriving at an electrode 20 of final diameter. The electrode column is united by a support system 3 and 4 uniting the graphite 20 with casing 40, and a fastening system to fix the casing to the amorphous coal electrode, for which it is necessary to mechanize the upper end of the final electrode to the inside diameter of casing 40. In this way, the furnace may continue to operate, burning out the conventional electrode and welding casings at their upper side, and sliding with traditional rings 43 until the casing 40 arrives at the height of the mixture.

Figure 2:
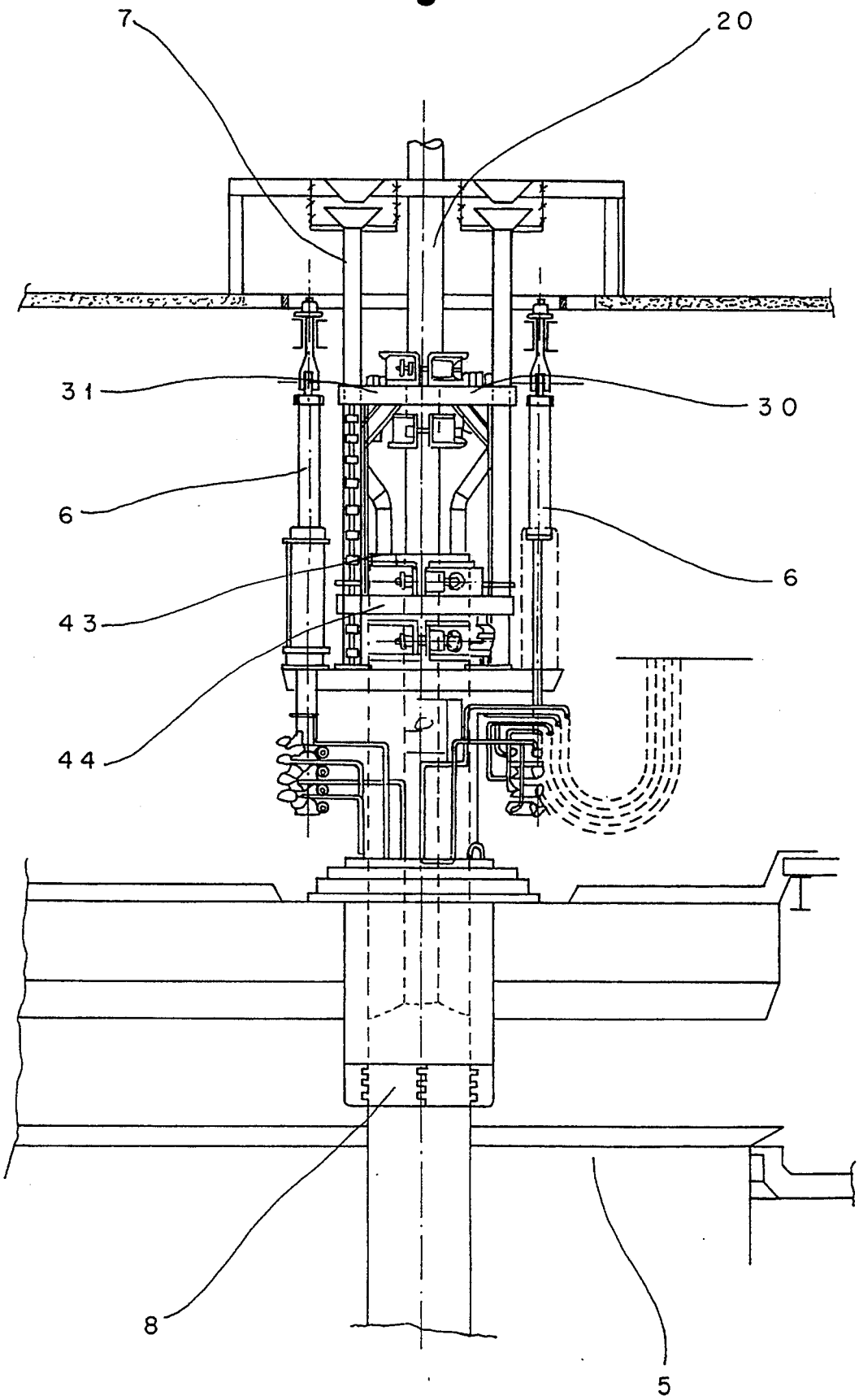
FIG. 2 is an elevational view of an apparatus with dual sliding means for independently sliding the graphite nucleus of the electrode.

FIG. 2 shows this installation with a second sliding system 30, which allows a limitation of supports 3 and 4 previously applied to the graphite. Utilizing the second sliding system, it is possible to slide only the graphite electrode 20, the casing being retained by the first sliding system 44 in order not to introduce the casing 40 and its impurities into the furnace. Alternatively, it is possible to independently slide the electrode with its casing by using conventional sliding system 44. When this is necessary, sliding rings 43 of lower system 44 are opened, and the sliding rings 30 of the upper sliding system 31 are activated. It is also possible to proceed by opening the upper rings 30 and utilizing the conventional system of rings 43 of the lower system 44.

Figure 2A:
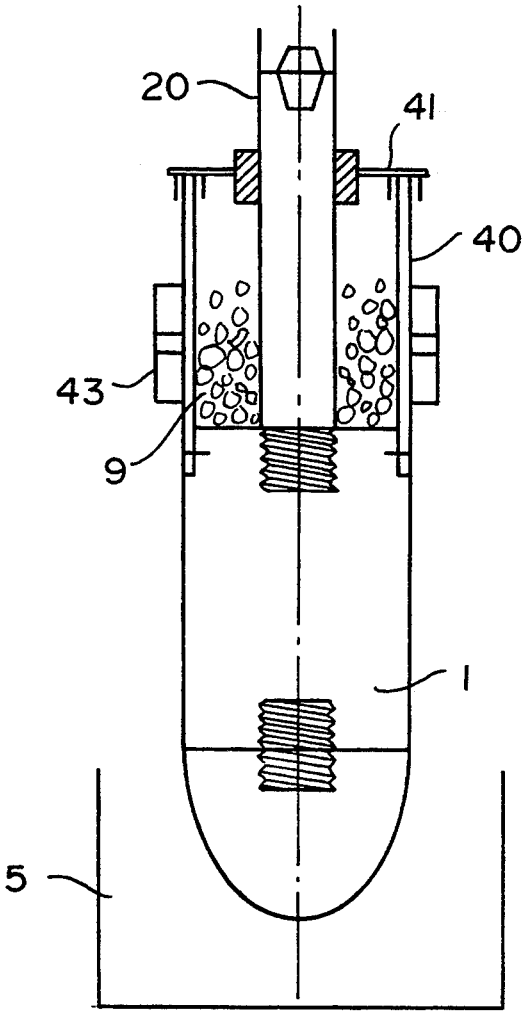
FIG. 2A is a schematic cross-sectional view of the lower sliding system portion of FIG. 2.

FIG. 2A shows the first or lower sliding system portion in greater detail, including furnace 5, paste 9 and a star or crosshead means 41 fastening graphite core 20 to casing 40.

Figure 2B:
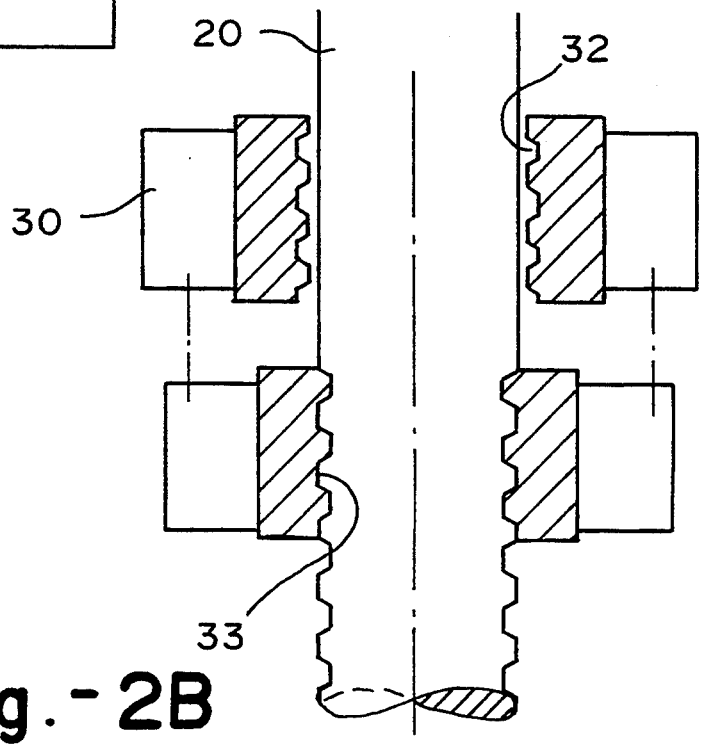
FIG. 2B is a schematic cross-sectional view of the upper sliding system portion of FIG. 2.

FIG. 2B shows the second or upper sliding means in greater detail. The system includes a pair of circumferential rings 30 which are internally toothed 32, but which could also be similarly fluted or embossed. When the rings 30 are clamped onto graphite core 20, the internal surface engraves the graphite core with a corresponding series of ridges, improving penetration of the paste into the graphite core and ultimately improving the binding of the paste with the graphite.

Figure 4:
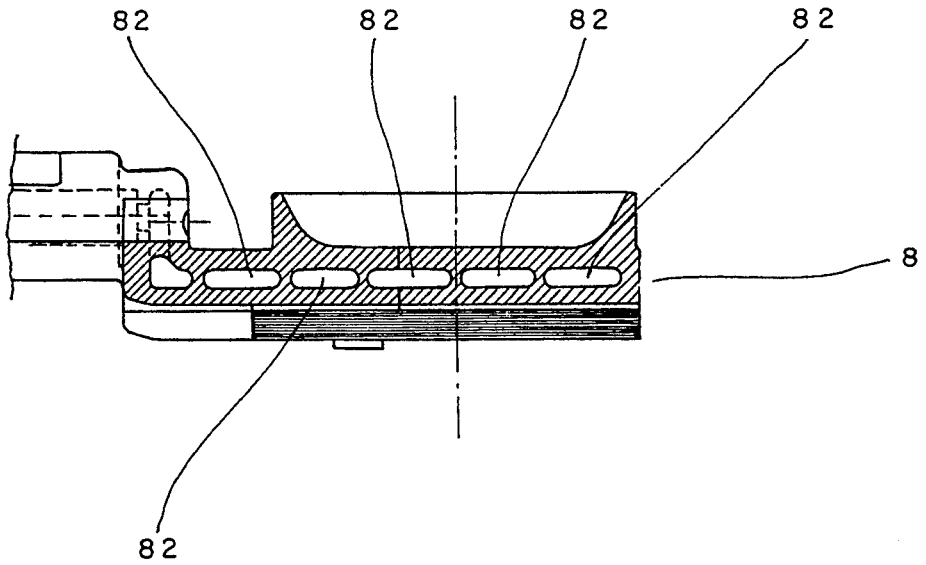
FIGS. 3, 4 and 5 are views of the electric conduction plates, in plan view, longitudinal section and side elevation, respectively.
Figure 3:
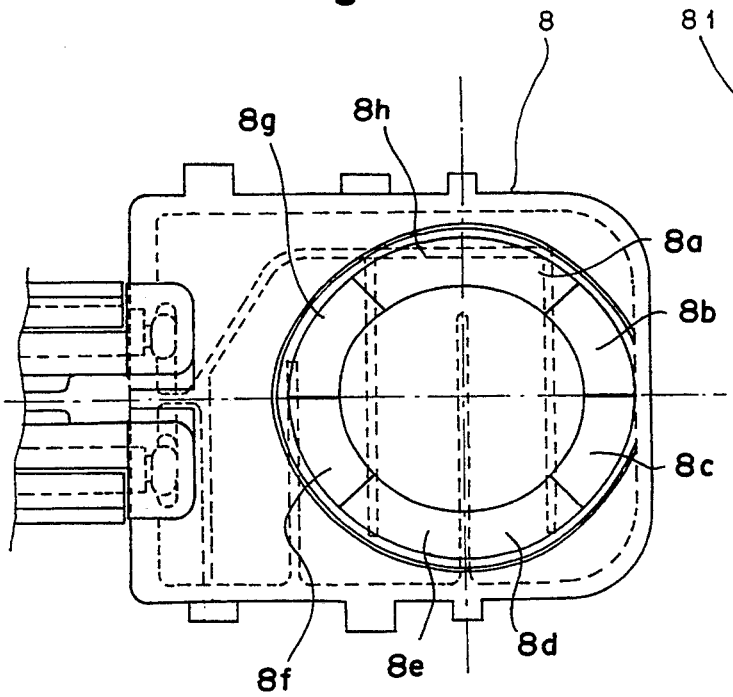
Figure 5:
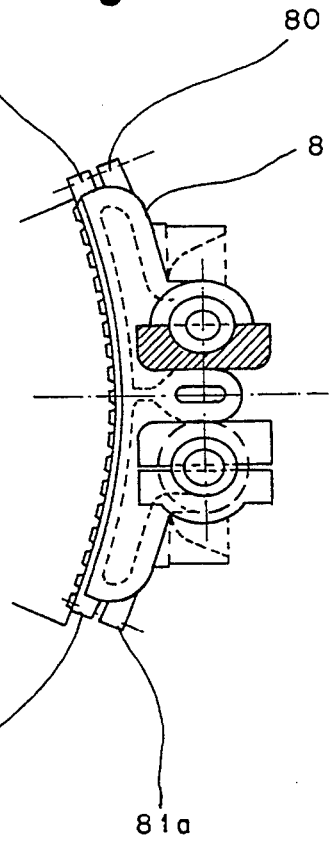

When changing the upper sliding rings 30, the type of plate 8 is also changed to the plate shown in FIGS. 3 through 5. According to the invention, the new plate 8 is characterized in its smaller size which is necessary in order to concentrate the electric current, in the subdivision of the plate into eight semi-circular segments 8*a* through 8h, and in the existence of projections 80-80A, and 81-81A, located on the lower and upper part of each end, and which have the object to line up the plates with others, so that in case of paste failure, the inside diameter will be kept in contact between plates 8 and it cannot be introduced within the casing 40. Plate 8 includes inside cooling means 82, which is lower than but of the same type as those normally used.

It is also possible to operate the furnace by means of a robot controlled by computer. Utilizing a robot, it is possible to maintain the height of the columns shown in FIG. 2 by means of suspension cylinders 6 within certain limits, so that on one hand the paste is not baked at a level where the hot gases from the process would melt the casing, and on the other hand, the process is not carried out in areas where baking of the paste would be insufficient.

Finally, it is also very important to obtain a continuous sliding of the electrodes. To this end, the hydraulic control system 31 for sliding is modified.

The invention is not limited to the exact details of this embodiment shown, but on the contrary, the invention may be modified whenever the essential characteristics of the invention are not changed.

What is claimed is:

1. A process for the continuous manufacture of an impurity and iron-free electrode for an electric arc furnace, comprising steps of sliding a prebaked graphite core downwardly within a casing above the furnace, introducing within the casing and surrounding the core a paste which is to bake to form the electrode, providing a contact plate for transmitting an electric current to the electrode, and sliding the electrode by means of a pair of sliding means in succession, including a first sliding means for retaining the casing, and a second sliding means for sliding the graphite core, the second sliding means comprising a pair of circumferential, internally fluted, toothed or embossed rings including successive opening and closing clamps, said rings engraving the graphite core with circumferential ridges for improved penetration of the paste and binding of the paste to the graphite core.

2. Process according to claim 1, wherein an amorphous coal electrode in operation with said furnace is to be replaced by an electrode having a graphite core and produced by said process for continuous manufacture, and wherein a union is made between the amorphous coal electrode and the casing utilizing a fastening means connecting the graphite core to the casing.

3. Process according to claim 1, wherein in the event of failure of the second sliding means, the first sliding means acts to displace the entire electrode by opening said pair of rings on said second sliding means.

4. Process according to claim 1, wherein said contact plate is subdivided into eight semi-circular segments, each having an arc of about 45°, which are substantially identical to assure contact position.

5. Process according to claim 4, wherein said sliding step is controlled by piston actuated cylinders which control the height of the contact plate above the furnace.

* * * * *